US005908108A

United States Patent [19]

Svopa

[11] Patent Number: 5,908,108

[45] Date of Patent: Jun. 1, 1999

[54] EXPECTANT FATHER SYSTEM

[76] Inventor: Ashley A. Svopa, 5335 NW. 119 Terr., Coral Springs, Fla. 33076

[21] Appl. No.: 09/102,708

[22] Filed: Jun. 22, 1998

[51] Int. Cl.[6] ..... B65D 69/00

[52] U.S. Cl. ..... 206/223; 206/803; 206/232; 206/459.5

[58] Field of Search ..... 206/223, 570, 206/575, 523, 579, 232, 38, 217, 459.5, 541, 803; 220/212

[56] References Cited

U.S. PATENT DOCUMENTS

| | | | |
|---|---|---|---|
| 3,254,756 | 6/1966 | Rankin . | |
| 3,323,643 | 6/1967 | Rush . | |
| 3,389,784 | 6/1968 | Hendricks et al. . | |
| 4,002,235 | 1/1977 | Donnelly | 206/219 |
| 4,062,446 | 12/1977 | Oyama | 206/223 |
| 4,108,311 | 8/1978 | McClendon | 206/573 |
| 4,177,593 | 12/1979 | Lockey | 40/488 |
| 4,194,629 | 3/1980 | Ledman et al. . | |
| 4,437,568 | 3/1984 | Hamblin . | |
| 4,901,664 | 2/1990 | Labrecque . | |
| 5,794,771 | 8/1998 | Krawec et al. | 206/223 |

*Primary Examiner*—Paul T. Sewell
*Assistant Examiner*—Nhan T. Lam

[57] ABSTRACT

An expectant father system that includes a thermal insulated carrying container constructed of an insulating plastic foam material that has a transparent baby name and birth date card receiving compartment on an exterior surface thereof, a beverage can sized item receiving compartment formed into the center thereof and accessible through a circular insertion opening defined by a perimeter lip, and a hook and pile carrying container fastener strip secured to the exterior surface adjacent to the perimeter lip. A baby name and birth date card is provided that is sized to fit into the transparent baby name and birth date card receiving compartment. The carrying container is filled with a variety of useful items for an expectant father including a number of cigar-shaped baby arrival candy gift items; a tubular "It's A Boy" candy gift item sleeve for each of the first plurality of cigar-shaped candy baby arrival candy gift items, each sized to receive therein one of the first plurality of cigar-shaped candy baby arrival candy gift items; and a tubular "It's A Girl" candy gift item sleeve for each of the first plurality of cigar-shaped candy baby arrival candy gift items, each sized to receive therein one of the first plurality of cigar-shaped candy baby arrival candy gift items. The carrying case is used as a beverage can cooler/holder while waiting and as a keepsake cooler/holder long after the baby is born.

2 Claims, 2 Drawing Sheets

32
10
16
74
76
34
36
46
68
44
26
28
12
30
70
40
14
24
42
18
22
20

EXPECTANT FATHER SYSTEM

TECHNICAL FIELD

The present invention relates to kits containing items useful for assisting individuals under a particular circumstance and more particularly to an exemplary embodiment of the expectant father system that includes a thermal insulated carrying container constructed of an insulating plastic foam material that has a transparent baby name and birth date card receiving compartment on an exterior surface thereof, a beverage can sized item receiving compartment formed into the center thereof and accessible through a circular insertion opening defined by a perimeter lip, and a hook and pile carrying container fastener strip secured to the exterior surface adjacent to the perimeter lip; a baby name and birth date card sized to fit into the transparent baby name and birth date card receiving compartment; a carrying container cover sized to cover the access opening of the carrying container and having an interior container rim receiving cavity defined by a hook and pile cover securing strip that is sized to receive the perimeter lip and carrying container fastener strip of the carrying container; a phone booklet positioned within the item receiving compartment of the carrying container; a first plurality of cigar-shaped baby arrival candy gift items; a tubular "It's A Boy" candy gift item sleeve for each of the first plurality of cigar-shaped candy baby arrival candy gift items, each sized to receive therein one of the first plurality of cigar-shaped candy baby arrival candy gift items; and a tubular "It's A Girl" candy gift item sleeve for each of the first plurality of cigar-shaped candy baby arrival candy gift items, each sized to receive therein one of the first plurality of cigar-shaped candy baby arrival candy gift items.

BACKGROUND ART

An expectant father must often drop everything to rush the mother of his child to the hospital. Because of the need to rapidly leave for the hospital, the expectant father can often forget to bring a variety of useful items that could make the waiting more pleasant. It would be a benefit, therefore, to have an expectant father system that included a number of items that could be of use to an expectant father while waiting for the delivery of the baby that includes a carrying case having a variety of useful items provided therein that can be kept in the expectant father's vehicle. In addition, it would be a further benefit to have an expectant father system that included at least one item that could be kept as a keepsake to remind the expectant father of the birth of the baby.

GENERAL SUMMARY DISCUSSION OF INVENTION

It is thus an object of the invention to provide an expectant father system that includes a carrying case having a variety of useful items provided therein.

It is a further object of the invention to provide an expectant father system that includes at least one keepsake item.

It is a still further object of the invention to provide an expectant father system that includes an insulated carrying case having a variety of useful items provided therein that can be stored within a vehicle.

It is a still further object of the invention to provide an expectant father system that includes a thermal insulated carrying container constructed of an insulating plastic foam material that has a transparent baby name and birth date card receiving compartment on an exterior surface thereof, a beverage can sized item receiving compartment formed into the center thereof and accessible through a circular insertion opening defined by a perimeter lip, and a hook and pile carrying container fastener strip secured to the exterior surface adjacent to the perimeter lip; a baby name and birth date card sized to fit into the transparent baby name and birth date card receiving compartment; an insulated carrying container cover sized to cover the access opening of the carrying container and having an interior container rim receiving cavity defined by a hook and pile cover securing strip that is sized to receive the perimeter lip and carrying container fastener strip of the carrying container; a phone booklet positioned within the item receiving compartment of the carrying container; a first plurality of cigar-shaped baby arrival candy gift items; a tubular "It's A Boy" candy gift item sleeve for each of the first plurality of cigar-shaped candy baby arrival candy gift items, each sized to receive therein one of the first plurality of cigar-shaped candy baby arrival candy gift items; and a tubular "It's A Girl" candy gift item sleeve for each of the first plurality of cigar-shaped candy baby arrival candy gift items, each sized to receive therein one of the first plurality of cigar-shaped candy baby arrival candy gift items.

It is a still further object to provide an expectant father system that accomplishes some or all of the above objects in combination.

Accordingly, an expectant father system is provided. The expectant father system includes a thermal insulated carrying container constructed of an insulating plastic foam material that has a transparent baby name and birth date card receiving compartment on an exterior surface thereof, a beverage can sized item receiving compartment formed into the center thereof and accessible through a circular insertion opening defined by a perimeter lip, and a hook and pile carrying container fastener strip secured to the exterior surface adjacent to the perimeter lip; a baby name and birth date card sized to fit into the transparent baby name and birth date card receiving compartment; an insulated carrying container cover sized to cover the access opening of the carrying container and having an interior container rim receiving cavity defined by a hook and pile cover securing strip that is sized to receive the perimeter lip and carrying container fastener strip of the carrying container; a phone booklet positioned within the item receiving compartment of the carrying container; a first plurality of cigar-shaped baby arrival candy gift items; a tubular "It's A Boy" candy gift item sleeve for each of the first plurality of cigar-shaped candy baby arrival candy gift items, each sized to receive therein one of the first plurality of cigar-shaped candy baby arrival candy gift items; and a tubular "It's A Girl" candy gift item sleeve for each of the first plurality of cigar-shaped candy baby arrival candy gift items, each sized to receive therein one of the first plurality of cigar-shaped candy baby arrival candy gift items. The terms "It's A Boy" and "It's A Girl" are used herein, respectively, to mean any designation used to indicate a male child and a female child. In preferred embodiment the expectant father system includes user selected items such as baby wipes, antacid tablets, aspirin, coins for phone calls and snacks, a prepaid phone card, a toothbrush and tube of toothpaste, etc. within the item receiving compartment of the carrying case.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
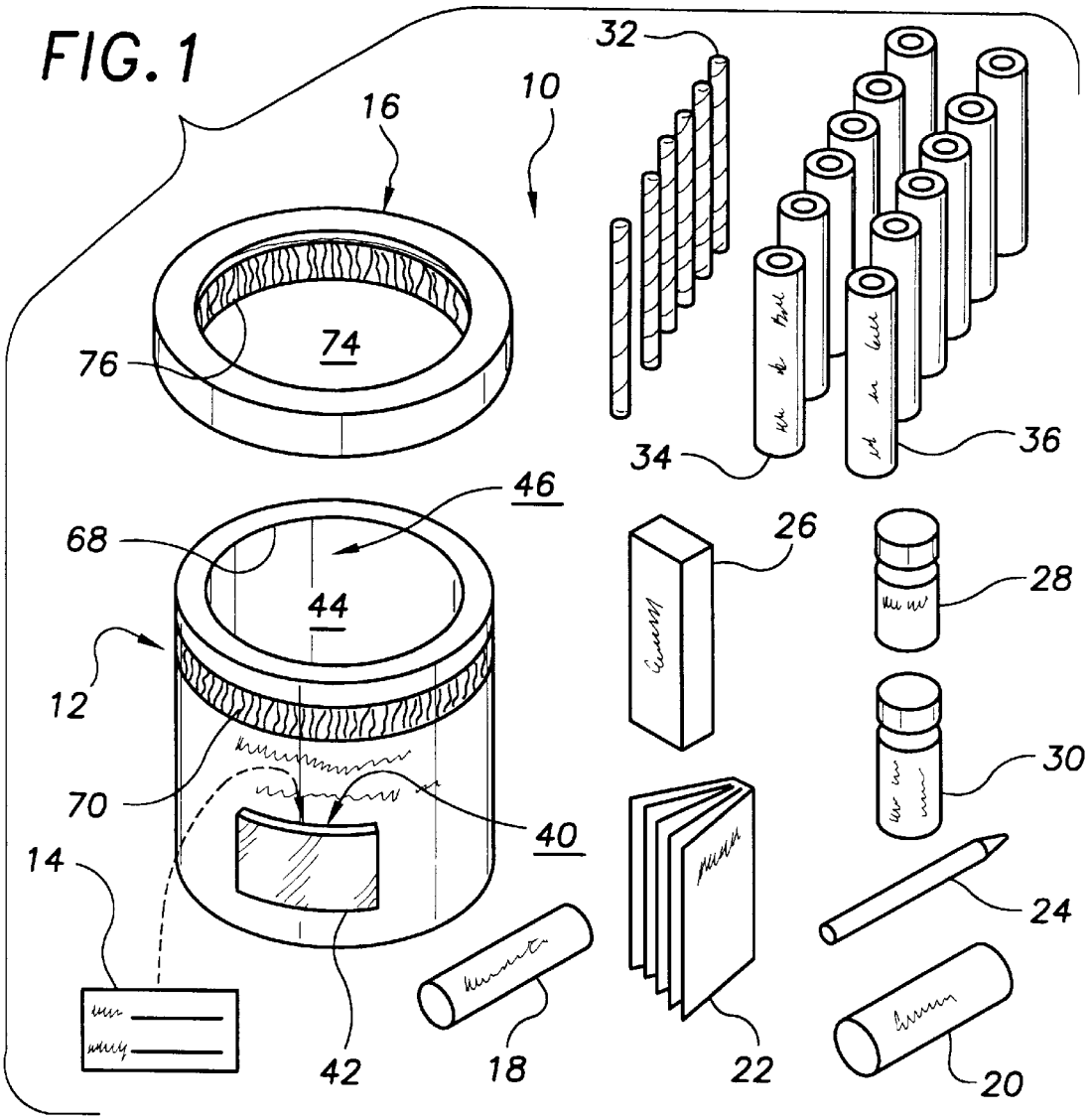
FIG. 1 is a perspective view of an exemplary embodiment of the expectant father system of the present invention showing the thermal insulated carrying container with the transparent baby name and birth date card receiving compartment on the exterior thereof and the beverage can sized item receiving compartment in the center thereof; the baby name and birth date card; the carrying container cover; the package of antacid tablets; a package of hard candies; the phone booklet; the writing instrument; the package of chewing gum; the container of headache pills; the container of smelling salts; the six cigar-shaped baby arrival candy gift items; the six tubular "It's A Boy" candy gift item sleeves; and the six tubular "It's A Girl" candy gift item sleeves.

FIG. 1 shows an exemplary embodiment of the expectant father system of the present invention, generally designated by the numeral 10. In this embodiment expectant father system 10 includes a thermally insulated carrying container, generally designated 12; a baby name and birth date card 14; a thermally insulated carrying container cover, generally designated 16; a package of antacid tablets 18; a package of hard candies 20; a phone booklet 22; a writing instrument 24; a package of chewing gum 26; a container of headache pills 28; a container of smelling salts 30; six cigar-shaped baby arrival candy gift items 32; six tubular "It's A Boy" candy gift item sleeves 34; and six tubular "It's A Girl" candy gift item sleeves 36.

Figure 2:
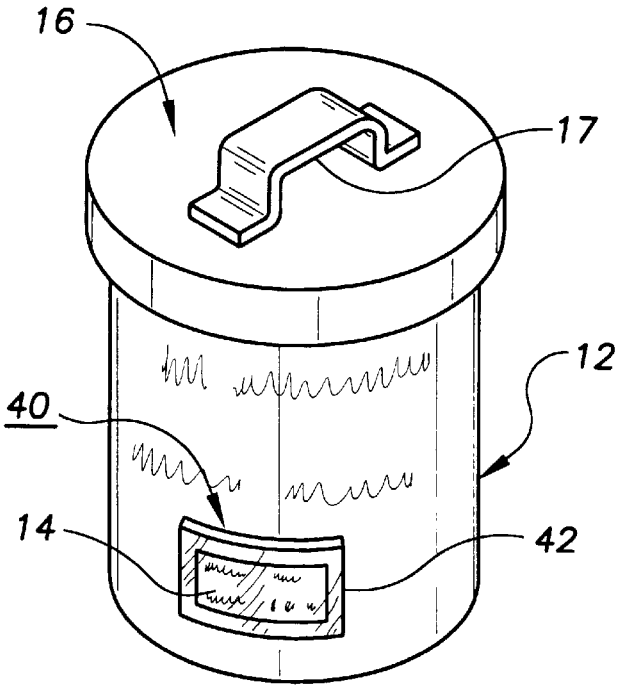
FIG. 2 is a perspective view showing the carrying container cover attached to and covering the insertion opening of the thermal insulated carrying container and the baby name and birth date card positioned within the transparent baby name and birth date card receiving compartment on the exterior of the thermal insulated carrying container.

Thermal insulated carrying container 12 and carrying case cover 16 are constructed of molded insulating plastic foam material. Carrying container 12 has a baby name and birth date card receiving compartment 40 formed on an exterior surface thereof by a transparent plastic pocket member 42 that is adhesively secured in place, a cylinder-shaped twelve-ounce beverage can sized item receiving compartment 44 formed into the center thereof that is accessible through a circular insertion opening 66 that is defined by a perimeter lip 68, and a hook and pile carrying container fastener strip 70 that is secured to the exterior surface adjacent to perimeter lip 68. Carrying container cover 16 is sized to cover access opening 44 of carrying container and has an interior container rim receiving cavity 74 that is partially defined by a circular hook and pile cover securing strip that is sized to receive the entire perimeter lip 68 and carrying container fastener strip 70 of carrying container 12. During assembly of expectant father system 10, baby name and birth date card 14, antacid tablets 18, hard candies 20, phone booklet 22, writing instrument 24, chewing gum 26, headache pills 28, smelling salts 30, the six cigar-shaped baby arrival candy gift items 32, the six tubular "It's A Boy" candy gift item sleeves 34, and the six tubular "It's A Girl" candy gift item sleeves 36 are positioned within item receiving compartment 44 and sealed therein by carrying container cover 16 as previously described and shown in FIG. 2. Carrying container cover 16 has a handle 17 provided on the top surface thereof to facilitate carrying of expectant father system 10. Because carrying container 12 and carrying container cover 16 are insulated, the items sealed within item receiving compartment 44 are protected from damage by heat when expectant father system 10 is stored within a vehicle glove box or the like.

Figure 3:
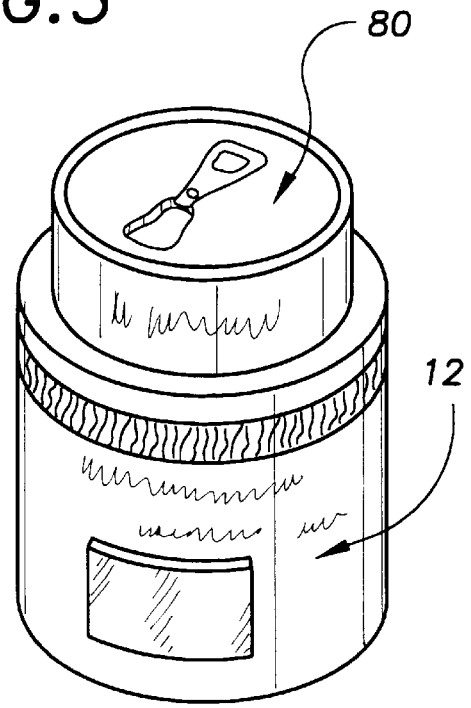
FIG. 3 is a perspective view showing a representative beverage can inserted into the beverage can sized item receiving compartment of the thermal insulated carrying container.

With reference to FIG. 3, additionally use of thermal insulating plastic construction allows carrying container 12 to be used to keep canned beverages cool by inserting a beverage can 80 into item receiving compartment 44 (FIG. 1). Referring back to FIG. 2, after the baby is born, the expectant father can fill in the name and birth date of the baby on the baby name and birth date card 14 and insert card 14 (also shown in FIG. 1) into baby name and birth date card receiving compartment 40 formed on the exterior surface of carrying container 12 behind transparent plastic pocket member 42 to create a permanent keepsake of the birth of the baby that can be used by the father at family parties and events to keep beverages cool.

With reference back to FIG. 1, once the sex of the baby is determined, the expectant father can insert one of the six cigar-shaped baby arrival candy gift items 32 into the appropriate "It's A Boy" or "It's A Girl" candy gift item sleeve 34,36, to give as announcement gifts.

It can be seen from the preceding description that an expectant father system has been provided that includes a carrying case having a variety of useful items provided therein; that includes at least one keepsake item; that includes an insulated carrying case having a variety of useful items provided therein that can be stored within a vehicle; and that includes a thermal insulated carrying container constructed of an insulating plastic foam material that has a transparent baby name and birth date card receiving compartment on an exterior surface thereof, a beverage can sized item receiving compartment formed into the center thereof and accessible through a circular insertion opening defined by a perimeter lip, and a hook and pile carrying container fastener strip secured to the exterior surface adjacent to the perimeter lip; a baby name and birth date card sized to fit into the transparent baby name and birth date card receiving compartment; an insulated carrying container cover sized to cover the access opening of the carrying container and having an interior container rim receiving cavity defined by a hook and pile cover securing strip that is sized to receive the perimeter lip and carrying container fastener strip of the carrying container; a phone booklet positioned within the item receiving compartment of the carrying container; a first plurality of cigar-shaped baby arrival candy gift items; a tubular "It's A Boy" candy gift item sleeve for each of the first plurality of cigar-shaped candy baby arrival candy gift items, each sized to receive therein one of the first plurality of cigar-shaped candy baby arrival candy gift items; and a tubular "It's A Girl" candy gift item sleeve for each of the first plurality of cigar-shaped candy baby arrival candy gift items, each sized to receive therein one of the first plurality of cigar-shaped candy baby arrival candy gift items.

It is noted that the embodiment of the expectant father system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An expectant father system comprising:

a thermal insulated carrying container constructed of an insulating plastic foam material that has a transparent baby name and birth date card receiving compartment on an exterior surface thereof;

a cylinder-shaped item receiving compartment formed into a center thereof that has a diameter sufficient to allow insertion therein of a beverage can and accessible through a circular insertion opening defined by a perimeter lip, and a hook and pile carrying container fastener strip secured to said exterior surface adjacent to said perimeter lip;

a baby name and birth date card sized to fit into said transparent baby name and birth date card receiving compartment;

an insulated carrying container cover sized to cover said access opening of said carrying container and having an interior container rim receiving cavity defined by a hook and pile cover securing strip that is sized to receive said perimeter lip and carrying container fastener strip of said carrying container;

a first plurality of cigar-shaped baby arrival candy gift items positioned within said item receiving compartment of said carrying container;

a tubular "It's A Boy" candy gift item sleeve for each of said first plurality of cigar-shaped candy baby arrival candy gift items positioned within said item receiving compartment of said carrying container, each "It's A Boy" candy gift item sleeve being sized to receive therein one of said first plurality of cigar-shaped candy baby arrival candy gift items; and a tubular "It's A Girl" candy gift item sleeve for each of said first plurality of cigar-shaped candy baby arrival candy gift items, each "It's A Girl" candy gift item sleeve being sized to receive therein one of said first plurality of cigar-shaped candy baby arrival candy gift items.

2. The expectant father system of claim 1, further including:

a phone booklet positioned within said item receiving compartment of said carrying container.

* * * * *